US006405444B1

(12) United States Patent
Osborne

(10) Patent No.: US 6,405,444 B1
(45) Date of Patent: Jun. 18, 2002

(54) APPARATUS FOR DRAWING BOUNDARY LINES ON A PLAY SURFACE

(75) Inventor: Thomas P. Osborne, Cincinnati, OH (US)

(73) Assignee: Sport Fun, Inc., Los Angeles, CA (US)

( * ) Notice: Subject to any disclaimer, the term of this patent is extended or adjusted under 35 U.S.C. 154(b) by 0 days.

(21) Appl. No.: 09/309,857

(22) Filed: May 11, 1999

(51) Int. Cl.[7] ..... B43L 9/00; B43L 9/04

(52) U.S. Cl. ..... 33/27.031; 33/27.032; 242/380

(58) Field of Search ..... 33/1 G, 27.01, 33/27.02, 27.03, 27.032, 413, 414, 27.031, 18.1, 18.2, 26, 32.1, 27.033; 242/380

(56) References Cited

U.S. PATENT DOCUMENTS

| | | | | | |
|---|---|---|---|---|---|
| 60,315 | A | * | 12/1866 | Worcester | 33/27.032 |
| 70,684 | A | * | 11/1867 | Bathgate | 33/414 |
| 295,076 | A | * | 3/1884 | Stevenson | 33/27.032 |
| 517,696 | A | * | 4/1894 | Hunter | 33/414 |
| 660,672 | A | * | 10/1900 | Vernon | 33/414 |
| 677,339 | A | * | 7/1901 | Comstockq | 33/27.032 |
| 809,139 | A | * | 1/1906 | Saxton | 33/761 |
| 889,570 | A | * | 6/1908 | Ayers | 33/761 |
| 2,474,864 | A | * | 7/1949 | Roedding | 33/27.031 |
| 2,499,673 | A | * | 3/1950 | Olejniczak | 33/27.031 |
| 2,893,122 | A | * | 7/1959 | Greco | 33/27.031 |
| 3,206,855 | A | * | 9/1965 | Fletcher | 33/87 |
| 3,335,498 | A | * | 8/1967 | Barbee | 33/761 |
| 3,526,964 | A | * | 9/1970 | Clark | 33/27.032 |
| 3,862,761 | A | * | 1/1975 | Conley | 369/69 |
| 4,125,231 | A | * | 11/1978 | Henderson | 242/375.3 |
| 4,192,078 | A | * | 3/1980 | Lore et al. | 33/414 |
| 4,438,538 | A | * | 3/1984 | Larsen | 33/760 |
| 4,551,847 | A | * | 11/1985 | Caldwell | 377/24 |
| 4,561,189 | A | * | 12/1985 | Hirneise | 33/408 |
| 4,660,291 | A | * | 4/1987 | Dehn | 33/414 |
| 4,760,648 | A | * | 8/1988 | Doak et al. | 33/668 |
| 4,765,557 | A | * | 8/1988 | Kahmann | 33/414 |
| 5,038,492 | A | * | 8/1991 | Bryant et al. | 33/758 |
| 5,042,159 | A | * | 8/1991 | Millen | 33/413 |
| 5,063,681 | A | * | 11/1991 | Bradley | 33/414 |

(List continued on next page.)

FOREIGN PATENT DOCUMENTS

| | | | | |
|---|---|---|---|---|
| SE | 162392 | * | 3/1958 | 33/761 |

*Primary Examiner*—Diego Gutierrez
*Assistant Examiner*—Maria Fernandez
(74) *Attorney, Agent, or Firm*—Ellsworth R. Roston; Fulwider Patton, et al.

(57) ABSTRACT

A hollow handle portion and a hollow barrel portion communicate with each other in a hollow housing. A first detent in the barrel portion has a first relationship for retaining a chalk in the barrel portion and a second relationship for releasing the chalk from the barrel portion. The detent is operable to the first and second relationships by a control member externally disposed on the barrel portion. A rotatable reel and a second detent are disposed in the handle portion. The second detent has a first relationship for preventing the reel from rotating and a second relationship for providing for the reel rotation. The second detent is operable to the first and second relationships by a second control member externally disposed on the handle portion. A string wound on the reel extends at a free end through an opening in the handle portion to a position external of the handle portion. A gripping member attached to the string free end provides for a manual unwinding of the string from the reel with the second detent in the second relationship. A rotary member externally disposed on the handle portion is coupled to the reel for rotation with the reel. The rotary member has a handle disposable in a first relationship flush with the rotary member and in a second relationship transverse to the rotary member. With the handle and the second detent in the second relationship the rotary member is rotatable to wind the string on the reel.

24 Claims, 3 Drawing Sheets

U.S. PATENT DOCUMENTS 5,331,744 A * 7/1994 Rumsey ..... 33/27.01
5,416,978 A * 5/1995 Kaufman ..... 33/668
5,427,383 A * 6/1995 Viens ..... 33/756
5,444,919 A * 8/1995 Alves ..... 33/414
5,448,837 A * 9/1995 Han-Teng ..... 33/761
5,471,761 A * 12/1995 Cheng ..... 33/755
5,509,616 A * 4/1996 Millen, Jr. et al. ..... 242/381.5
5,519,940 A * 5/1996 Brondtfield ..... 33/1 G
5,581,901 A * 12/1996 Takahashi ..... 33/756
5,735,052 A * 4/1998 Lin ..... 33/27.03
5,768,797 A * 6/1998 Trevinao ..... 33/761
5,920,997 A * 7/1999 Girtman ..... 33/414
5,928,095 A * 7/1999 Aldstadt ..... 473/490
5,935,025 A * 8/1999 Aldstadt ..... 473/490
6,019,630 A * 2/2000 Alpert ..... 439/501

* cited by examiner 40
76
82
42
46
74
63
44
68
81
62
66
68

APPARATUS FOR DRAWING BOUNDARY LINES ON A PLAY SURFACE

This invention relates to apparatus for providing visual markings on a surface. The apparatus is particularly adapted to provide visual markings relating to certain parameters (e.g. the foul line and the 3-point line) in a basketball court.

BACKGROUND OF THE INVENTION

Basketball is a popular sport in the United States. Great interest is shown at all levels—professional, college, high school and even grade school. Pick-up games between youngsters occur constantly. It is safe to say that participation in the United States alone in basketball games at all levels is in the millions of individuals.

The game of basketball has certain boundaries. For example, a large rectangle defines the boundaries of a basketball court. This large rectangle is bisected by a line defining the half court of each opponent. Within each half court there are a number of boundaries. For example, a semi-circle in each half court defines whether the scoring of a basket should provide two (2) points or three (3) points. A basket made by a player from a position within the semi-circle provides a score of two (2) points. A basket made by a player from a position outside of the semi-circle provides a score of three (3) points. Furthermore, a foul line and a semi-circle extending from the foul line defines an area within which a player makes foul throws. The successful completion of each foul throw provides a score of one (1) point.

Pick-up games on make-shift basketball courts are prevalent in the United States, particularly for youths under about sixteen (16) years in age. In these make-shift games, basketball courts often have to be improvised on an instantaneous basis. Since the tools required for improvising such basketball courts are generally not available, the improvised courts are often quite crude.

BRIEF DESCRIPTION OF THE INVENTION

This invention provides apparatus for delineating important dimensions of a basketball court on substantially an instantaneous basis. For example, a semi-circle can be drawn almost instantaneously by the apparatus of this invention at any desired radius to define the boundaries of a 2-point basket and a 3-point basket. The apparatus of this invention is also able to provide almost instantaneously a semi-circle which partially defines an area within which foul throws are made. Although the apparatus of this invention has been described to define the parameters of a basketball court, it will be appreciated that the apparatus can be used for a number of different purposes.

In the apparatus constituting this invention, a hollow handle portion and a hollow barrel portion communicate with each other in a hollow housing. A first detent in the barrel portion has a first relationship for retaining a chalk in the barrel portion and a second relationship for releasing the chalk from the barrel portion. The detent is operable to the first and second relationships externally disposed on the barrel portion by a control member.

A rotatable reel and a second detent are disposed in the handle portion. The second detent has a first relationship for preventing the reel from rotating and a second relationship for providing for the reel rotation. The second detent is operable to the first and second relationships by a second control member externally disposed on the handle portion.

A string wound on the reel extends at a free end through an opening in the handle portion to a position external of the handle portion. A gripping member attached to the string free end provides for a manual unwinding of the string from the reel with the second detent in the second relationship.

A rotary member externally disposed on the handle portion is coupled to the reel for rotation with the reel. The rotary member has a handle disposable in a first relationship flush with the rotary member and in a second relationship transverse to the rotary member. With the handle and the second detent in the second relationship, the rotary member is rotatable to wind the string on the reel.

DETAILED DESCRIPTION OF THE INVENTION

Figure 1:
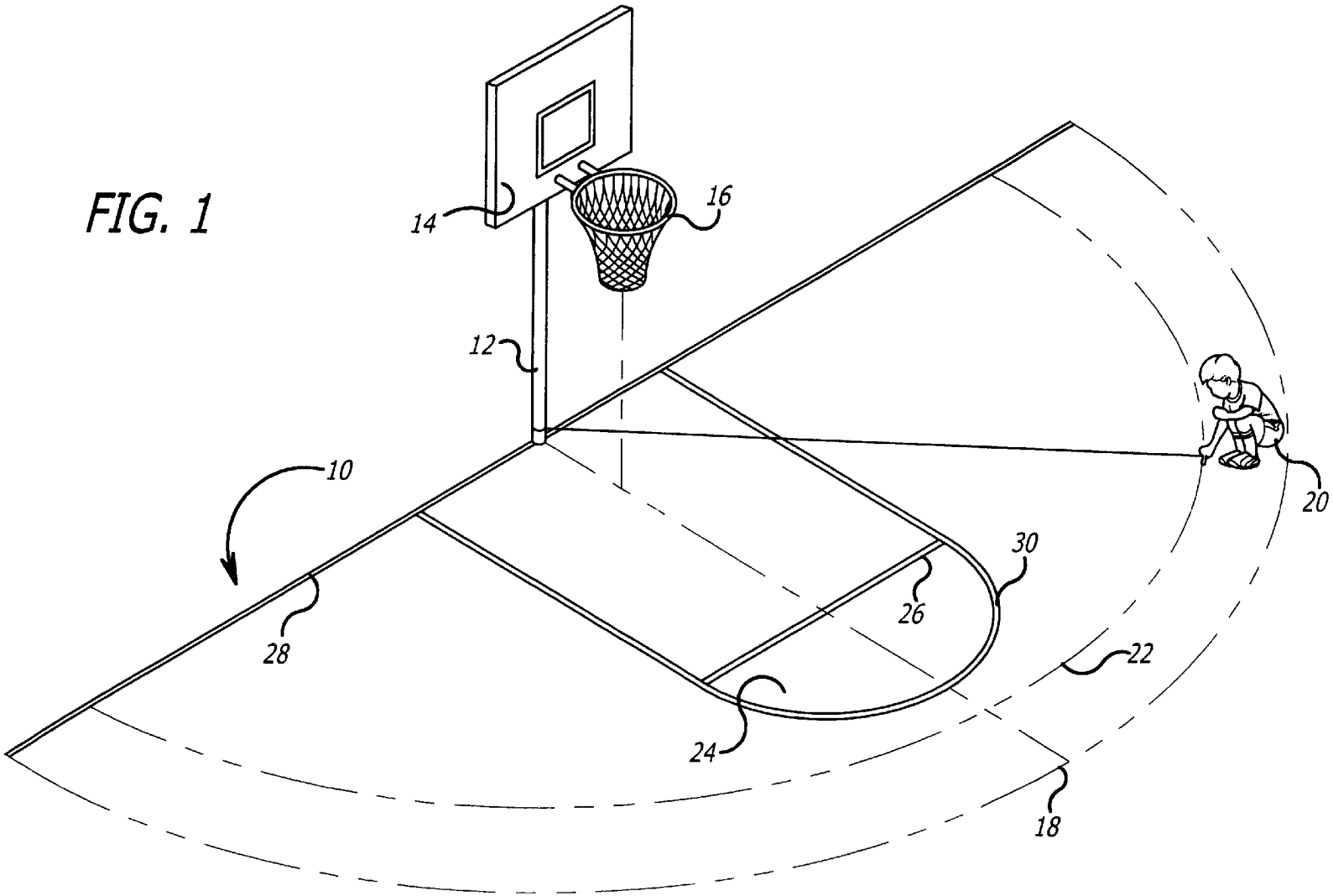
FIG. 1 is a schematic perspective view of a portion of a basketball court and schematically shows a youngster using the apparatus of this invention to draw lines defining the parameters of the basketball court.

A portion of a basketball court, generally indicated at 10, is shown in FIG. 1. The basketball court 10 includes a pole 12 at one end of the court, a backboard 14 attached to the pole at a position near the top of the pole and a basket 16 attached to the backboard at an intermediate position on the backboard.

A semi-circular line 18 is provided to define the boundary between 2-point baskets and 3-point baskets. A basket made by a player shooting within the semi-circular line 16 provides two (2) points. A basket made by a player outside of the semi-circular line 18 provides three (3) points. The line 18 is shown as being broken to indicate that it can be provided at any radius. For example, a young player 20 is shown as drawing a semi-circular line 22 at a shorter radius than the semi-circular line 18. It will be appreciated that the radius of the semi-circular line 18 or 22 is dependent upon the age and skill of the players.

FIG. 1 also shows an area 24 within which foul throws are made. The area 24 is defined in part by a line 26 parallel to the line 28 at which the pole 12 is disposed. The area 24 is also partially defined by a semi-circular line 30 which can be drawn by the apparatus of this invention.

Figure 2:
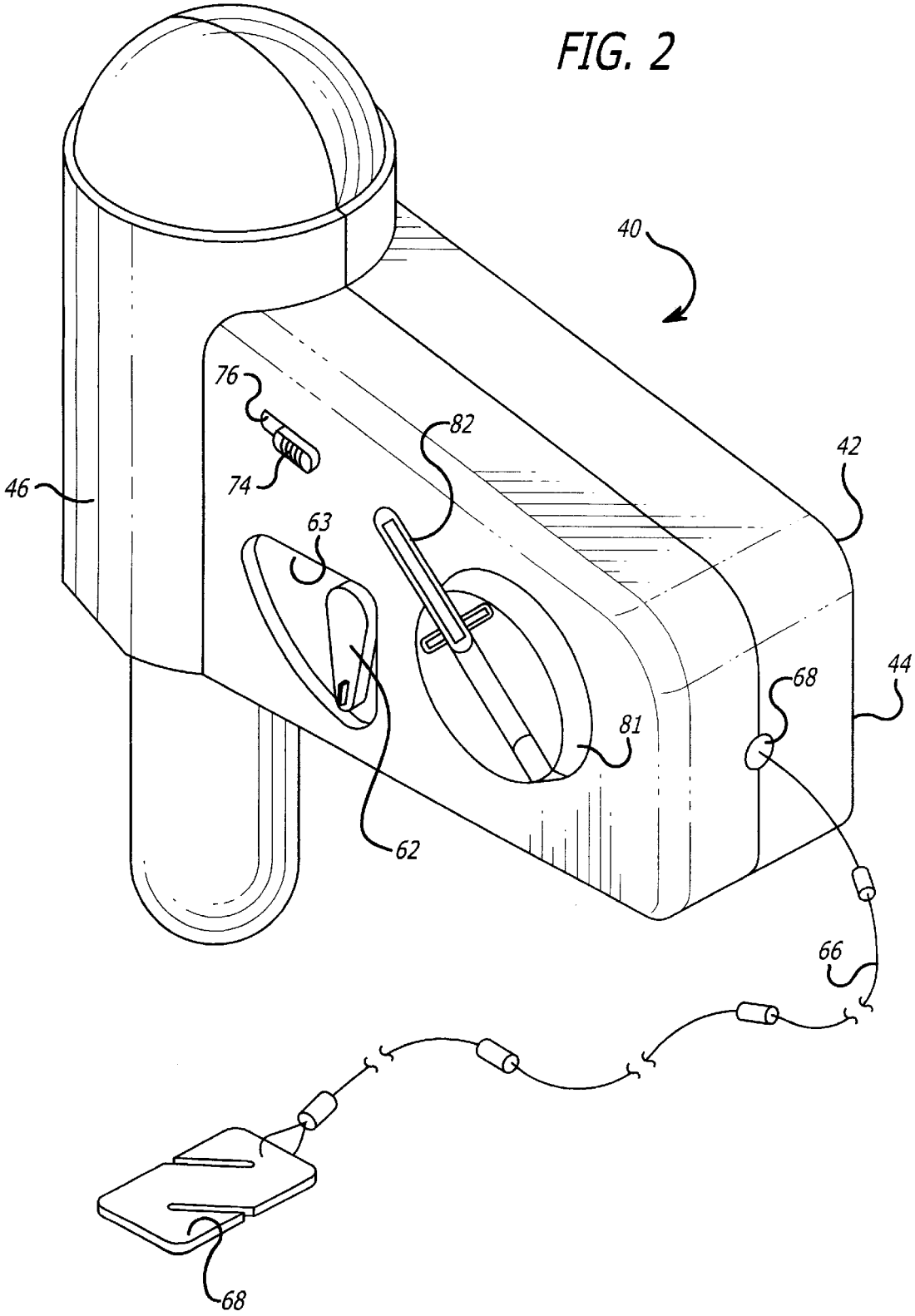
FIG. 2 is a schematic perspective of the apparatus of this invention.
Figure 3:
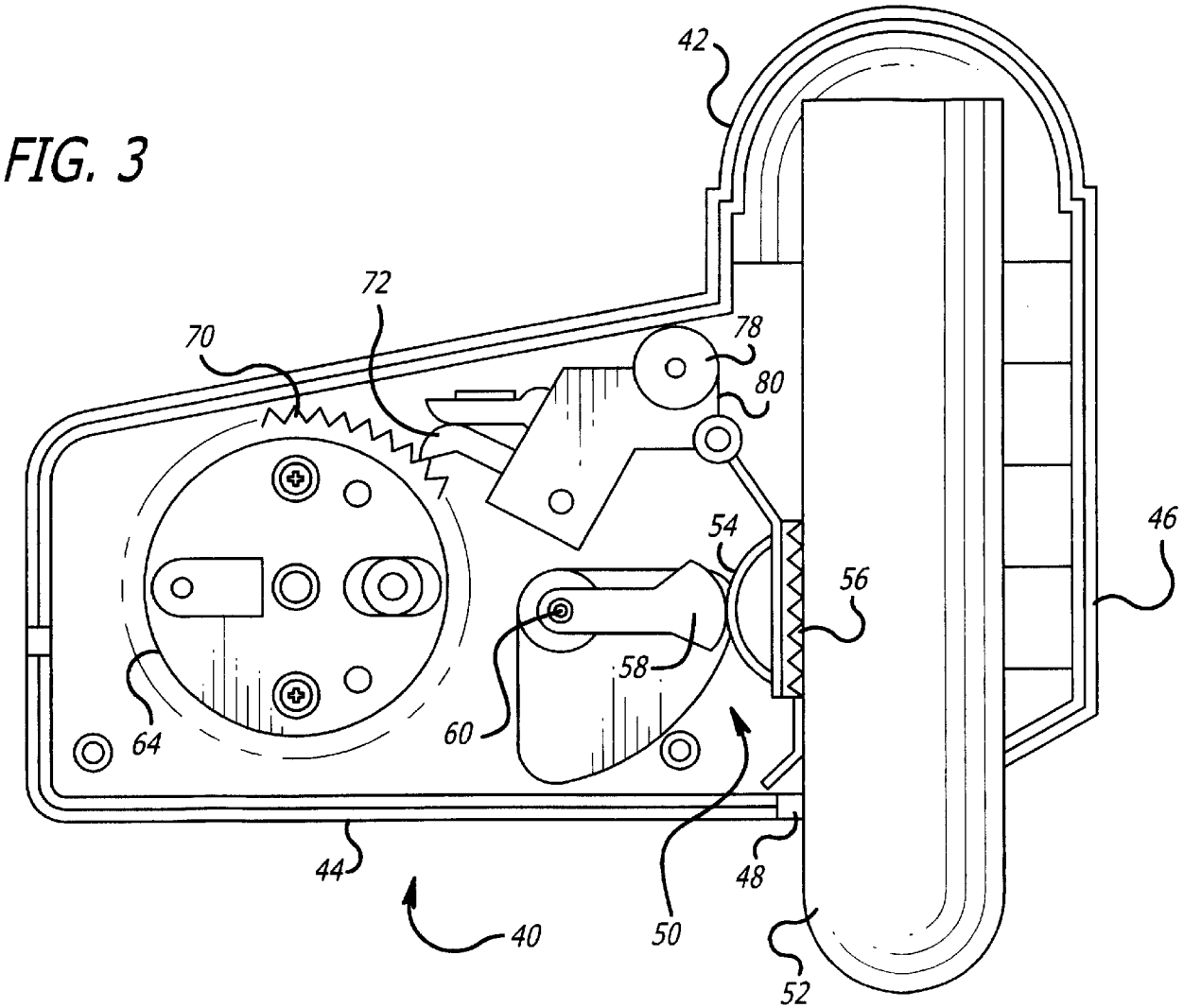
FIG. 3 is a sectional view of the components within the apparatus of this invention.

The apparatus of this invention is generally indicated at 40 in FIGS. 2 and 3. It includes a hollow housing 42 defined in part by a hollow handle portion 44 and a hollow barrel portion 46. The barrel portion 46 is transverse, preferably substantially perpendicular, to the handle portion 44 and communicates with the handle portion. An opening 48 is provided at one end of the barrel portion 46.

A detent generally indicated at 50 is disposed within the barrel portion 44 for holding or releasing a chalk 52. When the chalk 52 is disposed within the barrel portion 46, it extends through the opening 48 to provide visual indications on a surface such as the surface of the basketball court 10. The detent 50 is defined in part by a member 54 having teeth 56 for engaging the chalk 52. The detent 50 is also defined in part by a pivotable arm 58 which engages the member 54 in a first relationship and which is displaced from the member 54 in a second relationship. When the arm 58 engages the member 54, the chalk 52 is retained within the barrel portion 46. The member 54 is pivotable on a pin 60 between the first and second relationships by a control member 62 disposed in a socket 63 on the handle portion 44 externally of the handle portion.

A rotary reel 64 is disposed within the handle portion 44. A string 66 is wound on the reel 64. The string 66 extends outwardly from the handle portion through an opening 68 in the handle portion. A gripping member 68 is disposed at the free end of the string 66 to facilitate the unwinding of the string from the reel 64.

The movement of the pawl 72 between the first and second relationships is provided by a lug 74 disposed in a socket 76 in the handle portion 44 of the housing 42. The lug 74 is operatively coupled to a member 78 in the handle portion 74. The member 78 is in turn coupled to the pawl 72. A spring member 80 is disposed between the member 78 and a pin 82 to position the member 78 so that the pawl 72 engages the teeth in the rack gear 70 at all times except when the lug 74 is moved to the left in FIG. 2 in a direction to disengage the pawl from the teeth in the rack gear.

When it is desired to unwind the string 66 from the reel 64, the lug 74 is pressed to the left in FIG. 2. This releases the pawl 72 from the teeth on the rack gear 70. The string 66 is then free to be unwound from the reel 64 by manually gripping and pulling the string outwardly from the handle portion 64. The free end of the string 66 can then be attached to the pole 12 and the chalk 52 can be disposed on the surface of the basketball court 10 to draw the semi-circle such as the semi-circle 18 or the semi-circle 22. Alternatively, the free end of the string 66 can be attached to the pole 12, the lug 74 can be pressed to the left in FIG. 2 and the housing 42 can be moved to the desired position for drawing the semi-circle 22 or the semi-circle 18. Similar procedures can be provided for drawing the semi-circle 30.

When it is desired to rewind the string 66 on the reel 64, the handle 82 is pivoted upwardly so that it is transverse to the rotary member 81. The lug 74 is then moved to the left in FIG. 2 and the handle 82 is rotated in a direction to wind the string 66 on the reel 64. When it is desired to remove the chalk 52 from the barrel portion 66, the control member 62 is pivoted to the second relationship to release the chalk 52 for retention by the detent 50. A new chalk 52 can then be disposed in the barrel portion 46 of the housing 42.

Although the invention has been disclosed and illustrated with particular embodiments, the principles involved are capable of being used in numerous other embodiments which will be apparent to persons of ordinary skill in the art. The invention is, therefore, to be limited only as indicated by the scope of the appended claims.

What is claimed is:

1. In combination for providing for visual indications by a chalk on a surface, a housing having a hollow handle portion and a hollow barrel portion extending from the hollow handle portion in transverse relationship to the hollow handle portion, a reel disposed in the hollow handle portion for rotary movement and having a peripheral surface, a string wound on the peripheral surface of the reel, a first detent arrangement disposed in the handle portion of the housing and movable between first and second relationships, the first detent arrangement being operable in the first relationship to lock the reel against rotary movement and being displaced from the reel in the second relationship to provide for a rotary movement of the reel, and a second detent arrangement disposed in the hollow barrel portion of the housing and movable between first and second relationships, the second detent arrangement being operable in the first relationship to lock the chalk in the barrel portion and being operable in the second relationship to release the chalk from the barrel portion.

2. Apparatus as get forth in claim 1, including, a rotary member disposed externally of the handle portion and operatively coupled to the reel for providing for a rotation of the reel.

3. Apparatus as set forth in claim 2, including, a manually grippable member disposed at the end of the string for manual gripping to obtain an unwinding of the string from the reel.

4. Apparatus as set forth in claim 2, including, a handle disposed on the rotary member and pivotable on the rotary member between a first position in substantially flush relationship with the rotary member and a second position transverse to the rotary member for a manual gripping of the handle to provide for a rotary movement of the rotary member in a direction to wind the string on the reel.

5. Apparatus a set forth in claim 4, including, a lug disposed externally of the handle portion and operatively coupled to the first detent arrangement for providing for a manual operation of the first detent arrangement between the first and second relationships, and a member disposed externally of the barrel portion and operatively coupled to the second detent arrangement for providing for a manual operation of the second detent arrangement between the first and second relationships, and a manually grippable member disposed at the end of the string for manual gripping to obtain an unwinding of the string from the reel.

6. Apparatus for providing for visual indications by a chalk on a surface, including, a housing having a hollow handle portion and a hollow barrel portion extending from the hollow handle portion in a transverse relationship to the hollow handle portion, a reel disposed in the hollow handle portion for rotary movement and having a peripheral surface, a string wound on the peripheral surface of the reel, a first detent arrangement disposed in the handle portion of the housing and movable between first and second relationships, the first detent arrangement being operable in the first relationship to lock the reel against rotary movement and being displaced from the reel in the second relationship to provide for a rotary movement of the reel, a second detent arrangement disposed in the hollow barrel portion of the housing and movable between first and second relationships, the second detent arrangement being operable in the first relationship to lock the chalk in the barrel portion and being operable in the second relationship to provide for the release of the chalk from the barrel portion, a lug disposed externally of the handle portion and operatively coupled to the first detent arrangement for providing for a manual operation of the first detent arrangement between the first and second relationships, and a member disposed externally of the barrel portion and operatively coupled to the second detent arrangement for providing for a manual operation of the second detent arrangement between the first and second relationships.

7. Apparatus for providing for visual indications by a chalk on a surface, including, a hollow housing having a hollow handle portion and a hollow barrel portion extending from the handle portion in a transverse relationship to the handle portion for receiving and holding the chalk, a rotary reel disposed in the hollow handle portion, first detent means disposed in the hollow handle portion of the hollow housing in operatively coupled relationship to the reel and having first and second relationships and operative in the first relationship to prevent a rotation of the reel and operative in the second relationship to provide for a rotation of the reel, second detent means disposed in the hollow barrel portion of the hollow housing and having first and second relationships and operative in the first relationship to retain the chalk in the hollow barrel portion and operative in the second relationship to provide for a release of the chalk from the hollow barrel portion, a first opening in the hollow handle portion of the hollow housing, first means disposed on the hollow handle portion at the position of the first opening in the hollow handle portion and operatively coupled to the first detent means for providing for a manual movement of the first detent means between the first and second relationships, a second opening in the hollow handle portion of the hollow housing, second means disposed on the hollow handle portion at the position of the second opening in the hollow handle portion and operatively coupled to the second detent means for providing for a manual movement of the second detent means between the first and second relationships, and an opening in the hollow barrel portion for providing for an insertion of the chalk into the hollow barrel portion and for a release of the chalk from the hollow barrel portion.

8. Apparatus as set forth in claim 7, including, a rotary member disposed on the hollow handle portion externally of the hollow handle portion and operatively coupled to the reel for providing for a rotation of the reel with the rotation of the rotary member.

9. Apparatus as set forth in claim 8, including, there being an opening in the hollow handle portion, a string wound on the reel and having a free end and extending at its free end through the opening in the hollow handle portion for a manual withdrawal of the string from the reel and from the hollow handle portion, and a handle on the rotary member, the handle being pivotable relative to the rotary member between a first position in a flush relationship with the rotary member and a second position transverse to the rotary member to provide for a manual rotation of the rotary member and the reel with the handle in the second position.

10. Apparatus as set forth in claim 9, including, a grippable member disposed at the free end of the string for a manual gripping of the string to unwind the string from the reel to a position external of the hollow handle portion with the first detent means in the second relationship.

11. Apparatus as set forth in claim 9, including, a grippable member disposed at the free end of the string for a manual gripping of the string to unwind the string from the reel to a position external of the hollow handle portion.

12. Apparatus as set forth in claim 7, including, there being a third opening in the hollow handle portion, a string wound on the reel and having a free end and extending at its free end through the third opening in the hollow handle portion for a manual withdrawal of the string from the reel and from the hollow handle portion.

13. Apparatus as set forth in claim 7 wherein the first detent means is constrained by a spring to provide for the disposition of the first detent means in the first relationship except when the first detent means is being manually operated in the second relationship.

14. Apparatus for providing for visual indications by a chalk on a surface, including, a housing, having a hollow handle portion and a hollow barrel portion extending, from the hollow handle portion in a transverse relationship to the hollow handle portion, a reel disposed in the hollow handle portion for rotary movement and having a peripheral surface, a string wound on the peripheral surface of the reel, a first opening in the hollow handle portion of the hollow housing for passing the string through the first opening to a position external of the hollow handle portion, a rack gear disposed on the reel for rotary movement with the reel, a pawl movable between a first position engaging the rack gear to prevent rotation of the rack gear and the reel and a second position displaced from the rack gear to provide for a rotation of the rack gear and the reel, a spring operatively coupled to the pawl to bias the pawl to the first position, a second opening in the hollow handle portion of the housing, a lug disposed in the hollow handle portion of the hollow at the position of the second opening and movable between first and second positions and operatively coupled to the pawl for movement of the pawl to the first and second positions in accordance with the movement of the lug respectively to the first and second positions, and a detent arrangement disposed in the hollow handle position of the hollow housing and movable between first and second positions, the detent arrangement being operable in the first position to lock the chalk in the hollow barrel portion and being operable in the second position to provide for the release of the chalk from the hollow barrel portion.

15. Apparatus as set forth in claim 14, including, a socket in the hollow handle portion of the hollow housing, and a control member included in the detent arrangement and disposed in the hollow handle portion of the hollow housing at the position of the socket and movable between first and second positions, the detent arrangement including an arm movable between first and second positions in accordance with the movement of the control member between the first and second positions and operable in the first position to lock the chalk in the hollow barrel portion and operable in the second position to release the chalk for movement from the hollow barrel portion.

16. Apparatus as set forth in claim 14, including, a member included in the detent arrangement and having teeth for engaging the chalk to retain the chalk in the hollow barrel portion of the hollow housing, the member being engaged by the arm in the first position of the arm to lock the chalk in the barrel portion.

17. Apparatus as set forth in claim 16 wherein the control member is pivotable between the first and second positions and wherein the arm is pivotable with the control member between the first and second positions.

18. Apparatus as set forth in claim 17, including, a member included in the detent arrangement and having teeth for engaging the chalk to retain the chalk in the hollow barrel portion of the hollow housing, the member being engaged by the arm in the first position of the arm to lock the chalk in the barrel portion, a rotary member disposed on the hollow handle portion of the hollow housing externally of the housing and operatively coupled to the reel, and a handle normally disposed in a substantially flush relationship with the rotary member and pivotable to a position transverse to the rotary member for manual actuation to rotate the reel.

19. Apparatus as set forth in claim 14, including, a rotary member disposed on the hollow handle portion of the hollow housing externally of the housing and operatively coupled to the reel, and a handle normally disposed in a substantially flush relationship with the rotary member and pivotable to a position transverse to the rotary member for manual actuation to rotate the reel.

20. Apparatus for providing for visual indications by a chalk on a surface, including, a housing having a hollow handle portion and a hollow barrel portion extending from the hollow handle portion in a transverse relationship to the hollow handle portion, p1 a reel disposed in the hollow handle portion for rotary movement and having a peripheral surface, a string wound on the peripheral surface of the reel, a first opening in the hollow handle portion of the hollow housing for passing the string through the first opening to a position external of the hollow handle portion, a detent arrangement disposed in the hollow handle portion of the hollow housing and movable between first and second relationships, the detent arrangement being operable in the first relationship to lock the reel against rotary movement and being displaced from the reel in the second relationship to provide for a rotary movement of the reel, a member having teeth for engaging the chalk, a pivotable arm having first and second relationships and engaging the member in the first relationship to lock the teeth on the member against the chalk and displaced from the member in the second relationship to release the chalk from the teeth on the member, a socket in the hollow handle portion of the hollow housing, and a control member disposed in the hollow handle portion of the hollow housing at the position of the socket in the hollow handle portion and pivotable between first and second positions and operatively coupled to the pivotable arm for pivoting the arm between the first and second positions in accordance with the pivotable movement of the control member between the first and second positions.

21. Apparatus as set forth in claim 20, including, a second opening in the hollow handle portion of the hollow housing, and a lug included in the detent arrangement and disposed in the hollow handle portion of the hollow housing at the position of the second opening and movable between first and second positions and operable in the first position to prevent a rotation of the reel and operable in the second position to provide for a rotation of the reel.

22. Apparatus as set forth in claim 21, including, a rack gear included in the detent arrangement and disposed in the hollow handle portion on the reel for rotary movement with the reel, and a pawl included in the detent arrangement and disposed in the hollow handle portion and movable between a first position engaging the rack gear to prevent a rotation of the rack gear and the reel and a second position displaced from the rack gear and the reel to provide for a rotation of the rack gear and the reel.

23. Apparatus as set forth in claim 22, including, a spring included in the detent arrangement and disposed in the hollow handle portion of the hollow housing and operatively coupled to the pawl to bias the pawl to the first position.

24. Apparatus as set forth in claim 23, including, a rotary member disposed on the hollow handle portion of the hollow housing externally of the housing and operatively coupled to the reel, and a handle normally disposed in a substantially flush relationship with the rotary member and pivotable to a position transverse to the rotary member for a manual actuation to rotate the reel.

* * * * *

UNITED STATES PATENT AND TRADEMARK OFFICE

CERTIFICATE OF CORRECTION

PATENT NO. : 6,405,444 B1
DATED : June 18, 2002
INVENTOR(S) : Thomas P. Osborne

It is certified that error appears in the above-identified patent and that said Letters Patent is hereby corrected as shown below:

Column 3,
After line 9, add the following paragraph:
-- A rack gear 70 is disposed on the periphery of the reel 40. The rack gear 70 has teeth which are engaged by a pawl 72 in a first relationship of the pawl. In this relationship, the pawl 72 prevents the reel 64 from rotating. The pawl 72 is movable to a second relationship in which it no longer engages the teeth in the rack gear 70. In this relationship, the reel 64 is free to move in one direction to unwind the string 66 from the reel and is free to move in an opposite direction to wind the string on the reel. --.

After line 18, add the following paragraph:
-- A rotary member 81, is disposed on the handle portion 44 externally of the handle portion. The rotary member 81 is operatively coupled to the reel 64 for rotation with the reel. The rotary member 81 has a handle 82 which is normally disposed in flush relationship with the rotary member. The handle 82 is pivotable from this flush relationship to a position transverse to the rotary member. In this position, the handle 82, when manually actuated, rotates the reel 64 in a direction to wind the string on the reel. --.
Line 49, delete “In combination”, and replace with -- Apparatus --.
Line 50, after “surface,”, add, -- including, --.

Column 4,
Line 5, change “get”, to read -- set --.

Signed and Sealed this

Tenth Day of September, 2002

*Attest:*

*Attesting Officer*

JAMES E. ROGAN
*Director of the United States Patent and Trademark Office*